US006618574B2

(12) United States Patent
Nishitani

(10) Patent No.: US 6,618,574 B2
(45) Date of Patent: Sep. 9, 2003

(54) THIN FILM TYPE IMAGE HEATING APPARATUS WITH PRESSURIZING FORCE TRANSMITTING MEMBER FOR REGULATING MOVEMENT OF FILM

(75) Inventor: Hitoshi Nishitani, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/090,164

(22) Filed: Mar. 5, 2002

(65) Prior Publication Data

US 2002/0127034 A1 Sep. 12, 2002

(30) Foreign Application Priority Data

Mar. 7, 2001 (JP) ..... 2001-063195

(51) Int. Cl.[7] ..... G03G 15/20
(52) U.S. Cl. ..... 399/329
(58) Field of Search ..... 399/329, 328; 219/216

(56) References Cited

U.S. PATENT DOCUMENTS

| | | | | |
|---|---|---|---|---|
| 5,148,226 | A | 9/1992 | Setoriyama et al. | 355/290 |
| 5,149,941 | A | 9/1992 | Hirabayashi et al. | 219/216 |
| 5,525,775 | A | 6/1996 | Setoriyama et al. | 219/216 |

FOREIGN PATENT DOCUMENTS

| | | |
|---|---|---|
| JP | 63-313182 | 12/1988 |
| JP | 4-44075 | 2/1992 |
| JP | 4-44077 | 2/1992 |

*Primary Examiner*—Quana M. Grainger
(74) *Attorney, Agent, or Firm*—Fitzpatrick, Cella, Harper & Scinto

(57) ABSTRACT

The image heating apparatus has a heater, a film sliding against the heater, a roller forming a nip together with the heater via the film, a holding member for holding the heater, and a supporting member for supporting the roller. In the image heating apparatus, a recording material bearing an image is nipped and conveyed in the nip and the image on the recording material is heated by heat from the heater via the film, and the holding member is directly supported by the supporting member.

7 Claims, 4 Drawing Sheets

THIN FILM TYPE IMAGE HEATING APPARATUS WITH PRESSURIZING FORCE TRANSMITTING MEMBER FOR REGULATING MOVEMENT OF FILM

BACKGROUND OF THE INVENTION

1. Field of the Invention

The present invention relates to an image heating apparatus that is applied to an image forming apparatus such as a copying machine, a laser printer and a facsimile machine.

2. Related Art

Conventionally, as a fixing apparatus, a heat roller system has been generally employed, in which a recording material is passed through a pressing-contact portion of a pair of rollers, one or both of which being provided with a heater, to thereby fix an image on the recording material. In recent years, a film heating system disclosed in Japanese Patent Applications Laid-open Nos. 63-313182, 4-44075 and 4-44077 has also been employed, in which a pattern of a heating element is formed on a ceramic base material to create a heater and the heater is caused to generate heat, thereby heating a body to be heated via a thin film.

Since a heating body of low heat capacity can be used as a heater in a fixing apparatus of such a film heating system, waiting time can be further reduced (printing can be started more quickly) compared with the conventional heat roller system. In addition, since printing can be started more quickly, preheating becomes unnecessary during non-print operation, whereby comprehensive saving of power can be realized.

Incidentally, a base material of a heater is manufactured by dividing a plate that is large enough for cutting out several pieces of base material therefrom. The plate is divided by using a diamond cutter, by laser cutting or by shearing the plate along holes formed as perforation. However, it is likely that burrs or harmful protrusions exist on an end surface in any case.

Inserting such a heater into a nip in which a heat resistant film is sliding, with its ends in pressed contact with the nip, involves a significant risk from the viewpoint of abrasion durability.

That is, if a nip width is to be expanded to exceed a width of the heater, it is necessary to cut the base material of the heater by a method in which burrs or harmful protrusions are not generated on the end surface or implement processing for removing the burrs or harmful protrusions after cutting the base material of the heater, or use a heat resistant film which is not susceptible to burrs or harmful protrusions even if such burrs or protrusions exist.

Thus, in a generally adopted configuration, the heater width is set smaller than the nip width in order to avoid the secondary processing or the technical risks described above.

On the other hand, with increasing interest in the environmental issues in recent years, further energy saving is being sought. Under such circumstances, since half or more of power required for the printer is consumed by the fixing apparatus even in an electrophotographic printer having a fixing apparatus of the film heating system, such large power consumption by the fixing apparatus is now regarded as a problem. Thus, further saving of power by the improvement in thermal efficiency is sought even in the fixing apparatus of the film heating system.

As effective means for improving thermal efficiency of a fixing apparatus, there may be conceived of increasing a pressurizing force to enlarge a nip width, to thereby obtain a larger pressurizing and heating area.

However, since the task of making the nip width larger than a heater width involves the technical difficulties mentioned above, the nip width can be increased only to the extent that it does not exceed the heater width.

Next, as another effective means for improving thermal efficiency of a fixing apparatus, there may be conceived of enlarging a width of a heating element in a heater to obtain a larger heating area.

However, it is needless to mention that heat is not transmitted to a recording sheet if the heating element sticks out from a nip area. Thus, it is necessary to enlarge the nip width as the heating element is enlarged. However, due to the above-mentioned reason, the nip width can be enlarged only to the extent that it does not exceed the width of the heater. Therefore, it is necessary to set a dimension such that a relationship that the nip width is within the heater width and the heating element width is within the nip width can be always maintained.

FIGS. 4A, 4B, and 4C show a fixing apparatus according to a related art of the present invention. FIG. 4A is a perspective view, FIG. 4B is a side view and FIG. 4C is a view showing a nip portion.

In FIGS. 4A to 4C, reference numeral 100 denotes a heat resistant film, 102 denotes a heater, 102*a* denotes a heating layer (H is a width of the heating layer), 102*b* denotes a glass layer, 113 denotes a heater holding member, 104 denotes a metal stay, 115 denotes a resin member, 115*a* denotes a regulating surface for regulating the heat resistant film 100 in a width direction thereof, 115*b* denotes a pressure application location, 106 denotes a pressurizing roller, and 117 denotes a pressurizing roller supporting member. A pressure is applied on the pressure application location 115*b* of the resin member 115 by not-shown pressurizing means, whereby the heater 102 can be brought into pressed contact with the pressurizing roller 106 via the metal stay 104 and the heater holding member 113. The pressurizing roller 106 is subjected to rotational driving force by not-shown rotational driving means to rotate in a direction shown in the figure, whereby the pressurizing roller 106 is capable of conveying a recording sheet.

As shown in FIG. 4B, in a generally adopted construction, the pressurizing roller 106 is fit and positioned in the pressurizing roller supporting member 117 through a bearing, and the heater 102 is positioned in the heater holding member 113, the heater holding member 113 is fit and positioned in the resin member 115 within a portion A in the figure and the resin member 115 is fit and positioned in the pressurizing roller supporting member 117 within a portion B in the figure.

Therefore, dimensional allowances X1, X2, X3 and X4 shown in FIG. 4C are set such that the above-described relationship that the nip width (N) is within the heater width and the heating element width is within the nip width can be always maintained, even if loose fitting or a problem of inconsistencies in manufacturing occurs in assembling the above-mentioned members.

That is, the dimensional allowances X1, X2, X3 and X4 take relatively large values, which results in increased size of the heater.

Here, if the width of the heater 102 is enlarged, it is possible to enlarge the nip width without including ends of the heater 102 in the nip. However, if the width of the heater and the size of the heater holding member are enlarged, the entire heating apparatus becomes larger and, at the same time, a heat capacity of the apparatus itself is increased, which actually spoils the effect of improved thermal efficiency. Thus, it is not desirable to enlarge the width of the heater and the size of the heater holding member.

SUMMARY OF THE INVENTION

The present invention has been devised in view of the above-mentioned drawbacks, and it is an object of the present invention to provide an image heating apparatus in which thermal efficiency is improved to realize saving of power.

Another object of the present invention is to provide an image heating apparatus including: a heater; a film sliding against said heater; a roller forming a nip together with the heater via the film; wherein a recording material bearing an image is nipped and conveyed in the nip and the image on the recording material is heated by heat from the heater via the film, a holding member for holding the heater; and a supporting member for supporting the roller, wherein the holding member is directly supported by the supporting member.

Other objects of the present invention will become apparent from the following description.

DESCRIPTION OF THE PREFERRED EMBODIMENTS

Figure 2:
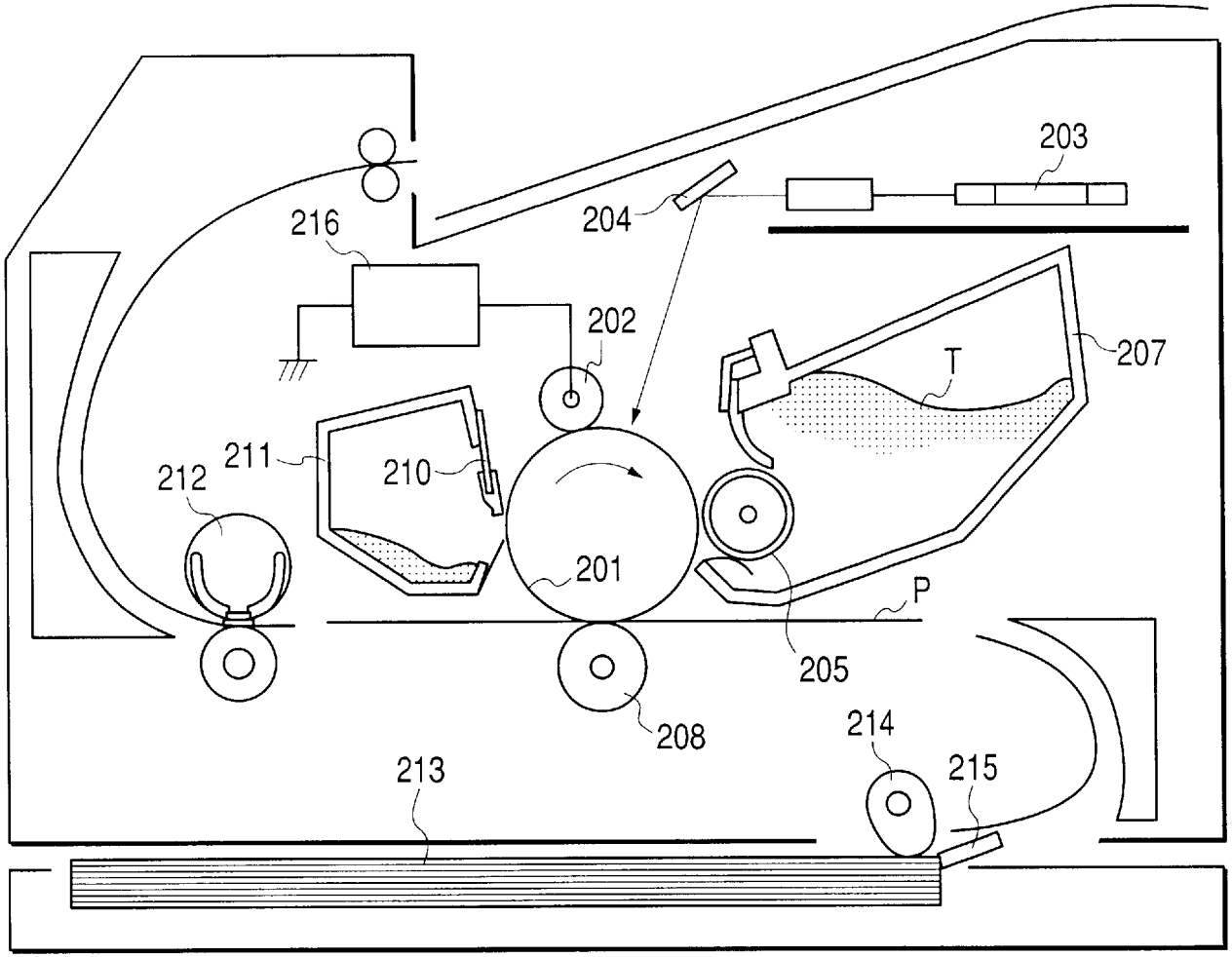
FIG. 2 shows an image forming apparatus to which the image heating apparatus in accordance with the embodiment of the present invention is applied.

Embodiments of the present invention will be hereinafter described with reference to the accompanying drawings. FIG. 2 shows an electrophotographic image forming apparatus to which an image heating apparatus according to an embodiment of the present invention is applied.

In FIG. 2, reference numeral 201 denotes a photosensitive drum, 202 denotes a charging roller, 203 denotes a laser exposing apparatus, 204 denotes a reflecting mirror, 205 denotes a developing sleeve, T denotes a toner, 207 denotes a toner container, 208 denotes a transferring roller, P denotes a sheet such as paper as a recording material, 210 denotes a cleaning blade, 211 denotes a waste toner container, 212 denotes a fixing apparatus functioning as an image heating apparatus, 213 denotes a paper cassette, 214 denotes a sheet feeding roller, 215 denotes a separating pad and 216 denotes a high voltage power source.

The photosensitive drum 201 rotates in the direction indicated by an arrow and is uniformly charged by the charging apparatus 202 to which power is supplied from the high voltage power source 216. A laser beam emitted from the laser exposing apparatus 203 is reflected by the reflecting mirror 204 and irradiated on the photosensitive drum 201, whereby an electrostatic latent image is formed on the photosensitive drum 201. The toner container 207 is filled with the toner T. An appropriate amount of toner is moderately charged and, then, supplied onto the photosensitive drum 201 following the rotation of the developing sleeve 205. The toner on the developing sleeve 205 adheres to the electrostatic latent image formed on the photosensitive drum 201, whereby the electrostatic latent image is developed and visualized as a toner image.

The sheet feeding roller 214 feeds a sheet P one by one from the paper cassette 213 at a given timing. The separating pad 215 is disposed abutting the sheet feeding roller 214. A friction coefficient, a ground contact angle and a shape of the surface of the separating pad 215 are adjusted such that only one sheet is fed at a time.

The visualized toner image on the photosensitive drum 201 is transferred onto a sheet by the transferring roller 208. Residual toner that was not transferred and remains on the photosensitive drum 201 is supplied to the waste toner container 211 by the cleaning blade 210 and contained therein. The photosensitive drum 201, the surface of which has been thus cleaned, starts the next image forming process over and over again. In addition, the sheet P bearing an unfixed toner image is subjected to heating and pressurizing by the fixing apparatus 212, whereby a toner image is permanently fixed thereon.

Figure 3:
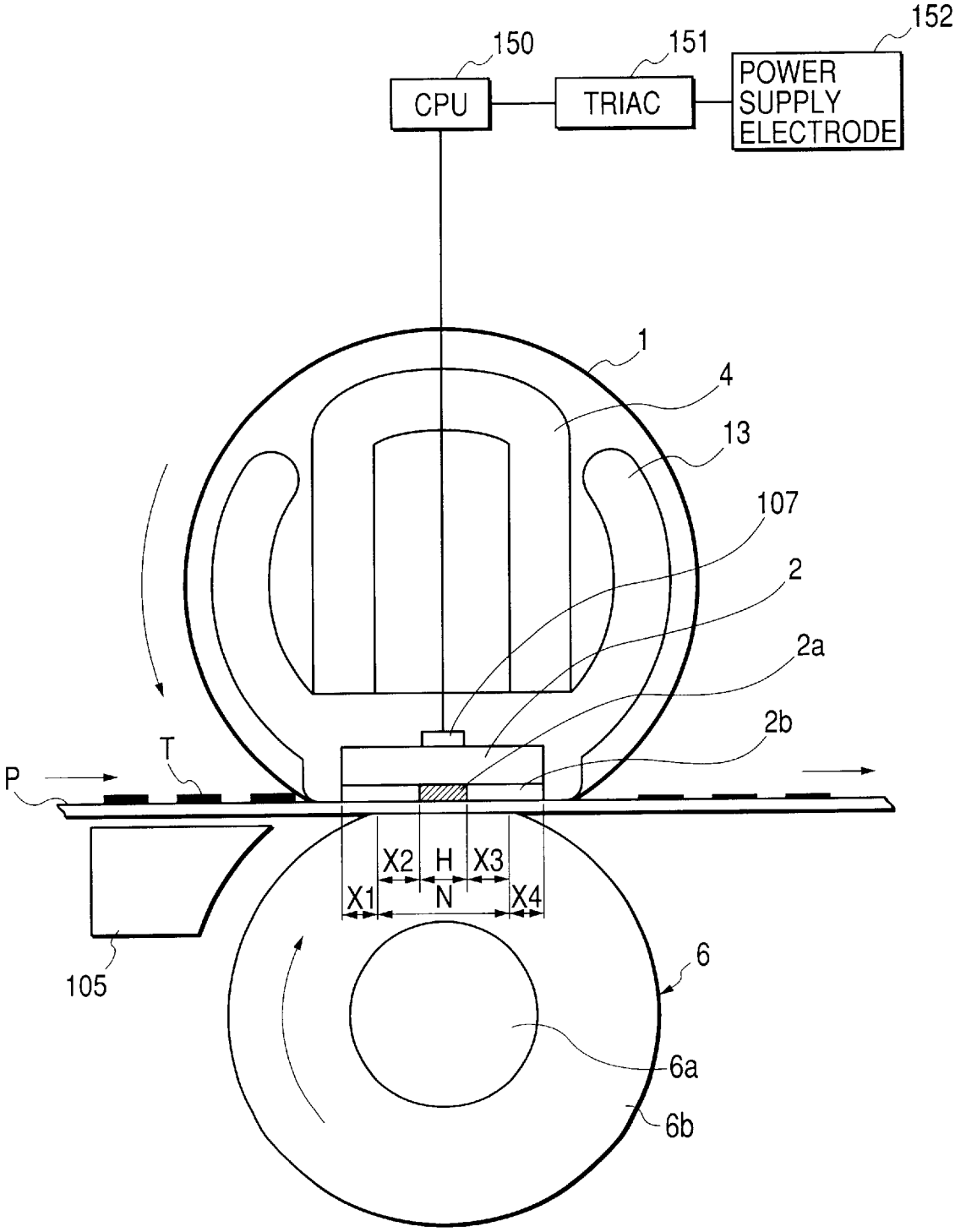
FIG. 3 shows an image heating apparatus in accordance with an embodiment of the present invention.

FIG. 3 shows the fixing apparatus. In FIG. 3, reference numeral 2 denotes a heater in which a heating element 2*a* (with a width of H as shown in the figure) is formed on a ceramic base material and a glass layer 2*b* is coated thereon as a protective layer. A thermistor 107 is mounted on the back of the heater 2 and senses a temperature of the heater 2. The heating element 2*a* is supplied with power from a not-shown power source and generates heat. At this point, a triac 151 is driven by a CPU 150 and an amount of power supplied to the heating element 2*a* through a power supply electrode 152 is controlled so that a temperature of the thermistor 107 is maintained constant.

Reference numeral 1 denotes an endless heat resistant film. The heat resistant film 1 is cylindrical and has a three-layer structure. An innermost layer is a base layer, which bears mechanical properties such as torsion strength and smoothness and is made of a resin such as polyimide, polyamideimide, PEEK, PES and PPS. The next layer is a conductive primer layer. The conductive primer layer is a conductive layer in which conductive particles such as carbon black are dispersed, and which also functions as an adhesive for joining a third layer and the base layer. An outermost layer is a top layer. The top layer is designed to have an optimum resistance value and film thickness to avoid occurrence of various image defects. The film 1 slides against the heater 2.

Reference numeral 13 denotes a heater holding member for holding the heater 2. The heater holding member 13 holds the heater 2, which is molded out of resin having heat resistance such as PPS and liquid crystal polymer and also functions as a guiding member for facilitating smooth rotation of the film 1. Reference numeral 4 denotes a metal stay, which is made of a metal such as iron and aluminum. The metal stay 4 functions to restrain deformation of the heater holding member 13 due to creep and improve rigidity of the heater holding member 13.

Reference numeral 6 denotes a pressurizing roller functioning as a backup member, in which a core metal 6*a* made of aluminum, pig iron (cast iron) or the like is covered by an elastic body 6 having a heat resistant property such as silicon rubber. The surface layer of the pressurizing roller 6 is provided with a film of a fluorocarbon resin such as PFA, PTFE and FEP having release properties with respect to toner.

The pressurizing roller 6 is brought into pressed contact with the heater 2 with the film 1 being interposed therebetween and forms a fixing nip portion N in the pressing-contact portion. The core metal 6*a* of the pressurizing roller 6 is rotatingly driven, which in turn causes rotation of the film 1 in the fixing nip portion N. A recording material P bearing the toner T is conveyed by the transferring roller 208 and the photosensitive drum 201 and guided to the fixing nip portion N by a fixing entrance guide 105. The toner T on the recording material P is pressed onto the recording material P and heated in the fixing nip portion N, whereby toner resin is softened and sticks to the recording material P to be permanently fixed thereon.

Figure 1A:
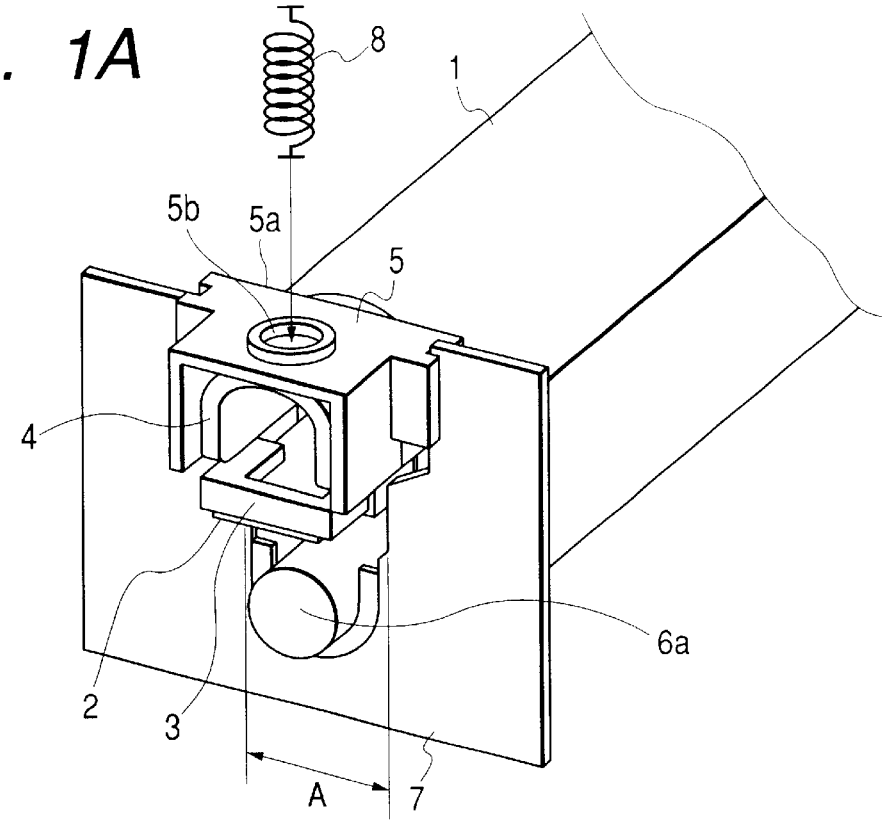
FIGS. 1A and 1B show an end portion of an image heating apparatus in accordance with an embodiment of the present invention.
Figure 1B:
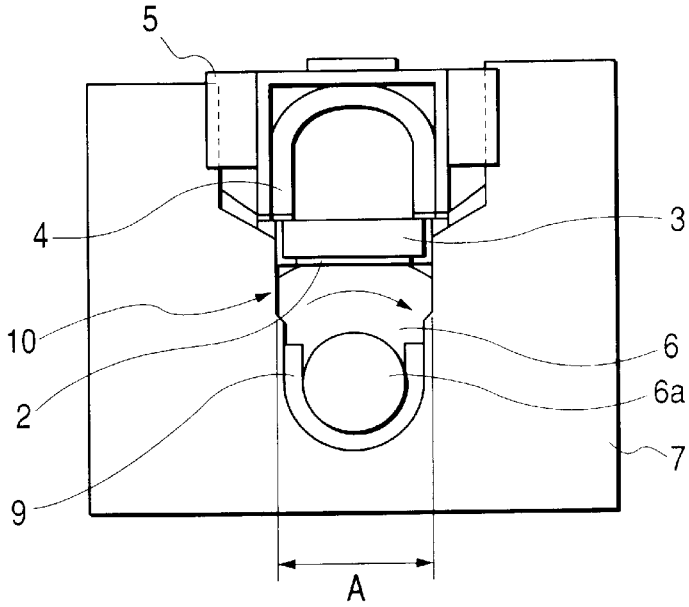

FIGS. 1A and 1B show an end portion of an image heating apparatus in an embodiment of the present invention. FIG. 1A is a perspective view and FIG. 1B is a side view.

In FIGS. 1A and 1B, reference numeral 1 denotes a heat resistant film, 2 denotes an elongated heater extending in a direction orthogonal to a conveying direction of a recording material, 3 denotes a heater holding member provided along the longitudinal direction of the heater, and 4 denotes a metal stay provided along the longitudinal direction of the heater 2. Reference numeral 5 denotes a pressurizing force transmitting member made of resin. Its inner end surface forms a regulating surface 5*a* for regulating a position of the film 1 in the width direction (direction orthogonal to the moving direction of the film 1). A spring seat on its upper surface forms a pressure application location 5*b*, on which an end of a compression spring abuts.

Reference numeral 6 denotes a pressurizing roller and 7 denotes a pressurizing roller supporting member.

A pressure is applied on the pressure application location 5*b* of the pressurizing force transmitting member 5 by the compression spring 8 functioning as pressurizing means, whereby the heater 2 can be brought into pressed contact with the pressurizing roller 6 via the metal stay 4 and the heater holding member 3. The pressurizing roller 6 is subjected to rotational driving force by not-shown rotational driving means to rotate in the direction indicated by an arrow, whereby the pressurizing roller 6 is capable of conveying a recording material (sheet). Further, the compression spring 8 and the pressurizing force transmitting member are provided on both end sides in the longitudinal direction of the heater 2.

As shown in FIGS. 1A and 1B, a shaft 6*a* of the pressurizing roller 6 is positioned in the pressurizing roller supporting member 7 via a bearing 9, and the heater 2 is fit and held on the heater holding member 3. The heater holding member 3 is fit and positioned not via the pressurizing force transmitting member but directly in the pressurizing roller supporting member 7 with a position A in the figure.

That is, the pressurizing roller supporting member 7 has a recessed portion 10 opening upward, supports the pressurizing roller 6 on the bottom side (lower part) of the recessed portion 10 and supports the heater holding member 3 on the opening side (upper part) of the recessed portion 10. Then, the pressurizing roller supporting member 7 positions the heater holding member 3 in the conveying direction of the recording material.

Figure 4A:
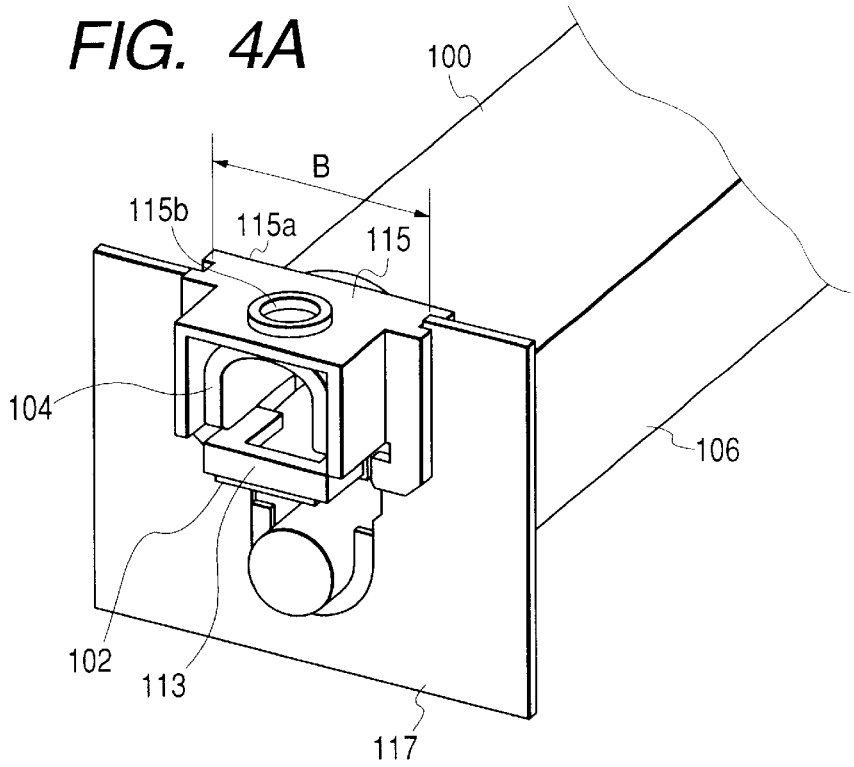
FIGS. 4A, 4B and 4C show an image heating apparatus in accordance with a related art of the present invention.
Figure 4B:
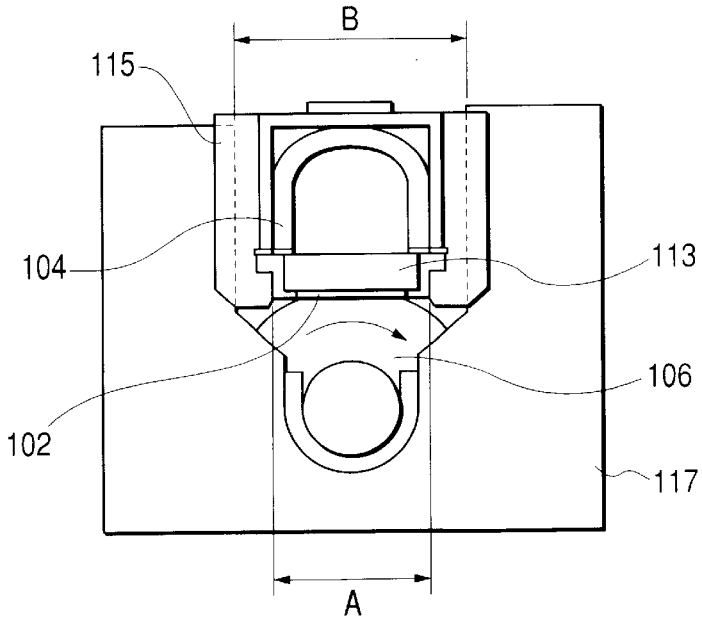

Here, accuracy of the dimension A of the pressurizing force transmitting member 115 in FIGS. 4A, 4B is particularly poor because the pressurizing force transmitting member 115 is formed in a reverse U shape. Thus, when the heater holding member 113 is supported by the pressurizing roller supporting member 117 via the pressurizing force transmitting member 115, the positional accuracy of the nip width of the pressurizing roller 106 with respect to the heating element of the heater 102 is deteriorated.

Figure 4C:
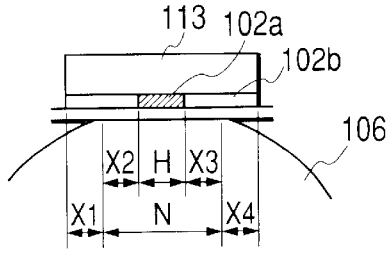

On the other hand, according to this embodiment, since the heater holding member 3 and the pressurizing roller supporting member 7 are fit and positioned not via the pressurizing force transmitting means 5 but directly, the positional accuracy of the nip width of the pressurizing roller 6 with respect to the heating element of the heater 2 is improved compared with the apparatus shown in FIGS. 4A, 4B and 4C.

Consequently, the dimensional allowances X1, X2, X3 and X4 can be set smaller than those in the apparatus shown in FIG. 4C, whereby it becomes possible to set the nip width and the heating element width wider if the width of the heater 2 is constant.

As a result, thermal efficiency in the nip is improved and temperature rise of the heater can be quickened when the same power is applied. Since a target temperature is reached earlier if the temperature rise of the heater is quickened, power can be reduced faster, whereby it becomes possible to restrain an amount of energy consumption.

In addition, since a quantity of heat taken up by the supporting member is reduced even when a set temperature is maintained such as when passing a sheet, an amount of energy consumption during a normal use can be reduced.

Due to the effects mentioned above, the heating apparatus with a short preheating time and a small amount of power consumption can be provided.

Although an example of the heater having the heating element formed on its lower surface is described in this embodiment, it is needless to mention that a heater with a heating element formed on its upper surface enjoys similar effects.

As described above, according to the present invention, it is possible to enlarge the nip width and the heating element width without increasing the overall size of the image heating apparatus that is constituted by the heater and without changing the heat capacity of the apparatus itself, to thereby realize saving of power by the improved thermal efficiency.

Conversely, according to the present invention, it is also possible to make the heater and the heater holding member smaller without changing the nip width and the heat element width and to reduce the heat capacity of the image heating apparatus itself to thereby realize saving of power by the improved thermal efficiency.

Thus, it is seen that an image heating apparatus is provided. One skilled in the art will appreciate that the present invention can be practiced in a form other than the preferred embodiment which is presented for the purposes of illustration and not of limitation, and the present invention can be modified in any way without deviating from the technical ideas of the present invention.

What is claimed is:

1. An image heating apparatus comprising:

a heater;

a film sliding against said heater;

a roller forming a nip together with said heater via said film;

wherein a recording material bearing an image is nipped and conveyed in said nip and the image on the recording material is heated by heat from said heater via said film, and a holding member for holding said heater;

a supporting member for supporting an end portion of said roller; and a pressurizing force transmitting member for transmitting a pressurizing force to said holding member, said pressurizing force transmitting member being inserted in said supporting member and said pressurizing force transmitting member having a function of regulating movement in a lengthwise direction of said film, wherein said holding member is pressurized to a side of said roller by said pressurizing force transmitting member, and said holding member is directly supported by said supporting member without being supported by said pressurizing force transmitting member.

2. An image heating apparatus according to claim 1, wherein said supporting member positions said holding member in a conveying direction of the recording material.

3. An image heating apparatus according to claim 1, wherein said supporting member has a recessed portion and supports said roller and said holding member on a bottom side and on an opening side of said recessed portion, respectively.

4. An image heating apparatus according to claim 1, wherein said heater has a base material and a heating element provided on said base material.

5. An image heating apparatus according to claim 1, wherein said supporting member supports said roller via a bearing.

6. An image heating apparatus according to claim 1, wherein said heater is elongate and pressure is applied to both end sides in a longitudinal direction of said heater.

7. An image heating apparatus according to claim 6, further comprising a stay provided on a side opposite to said heater on said holding member, wherein the pressure applied to said pressurizing force transmitting member is applied to said heater via said stay and said holding member.

* * * * *

UNITED STATES PATENT AND TRADEMARK OFFICE

CERTIFICATE OF CORRECTION

PATENT NO. : 6,618,574 B2
DATED : September 9, 2003
INVENTOR(S) : Hitoshi Nishitani It is certified that error appears in the above-identified patent and that said Letters Patent is hereby corrected as shown below:

Title page,
Item [56], References Cited, FOREIGN PATENT DOCUMENTS, insert:
-- JP 8-328406 12/1996 --.

Signed and Sealed this

Eleventh Day of May, 2004

JON W. DUDAS
*Acting Director of the United States Patent and Trademark Office*